US006227266B1

(12) United States Patent
Moore et al.

(10) Patent No.: US 6,227,266 B1
(45) Date of Patent: May 8, 2001

(54) COLLAPSIBLE GAS LEVER LOCK

(76) Inventors: Vincent Moore, 14369 St. Mary's, Detroit, MI (US) 48227; Artimio Blackburn, 4807 Spring Creek La., Atlanta, GA (US) 30350

( * ) Notice: Subject to any disclaimer, the term of this patent is extended or adjusted under 35 U.S.C. 154(b) by 0 days.

(21) Appl. No.: 09/587,106

(22) Filed: Jun. 2, 2000

(51) Int. Cl.[7] ..... B65B 3/00
(52) U.S. Cl. ..... 141/392; 251/90
(58) Field of Search ..... 141/392; 251/90, 251/111; D8/349, 354; D15/9.1

(56) References Cited

U.S. PATENT DOCUMENTS

| | | | | |
|---|---|---|---|---|
| 4,210,181 | * | 7/1980 | Clevenger | 141/392 |
| 4,683,923 | | 8/1987 | Harris | 141/392 |
| 4,722,375 | | 2/1988 | Fox | 141/392 |
| 4,811,765 | | 3/1989 | Giha | 141/392 |
| 4,846,447 | | 7/1989 | Hanna | 267/182 |
| 4,874,151 | | 10/1989 | Fritz | 251/90 |
| 5,752,554 | | 5/1998 | Campbell | 141/392 |

* cited by examiner

*Primary Examiner*—J. Casimer Jacyna
(74) *Attorney, Agent, or Firm*—Joseph N. Breaux

(57) ABSTRACT

A collapsible gas lever lock that is inserted between the gas lever and the bottom of the gas pump handle to maintain the gas lever in the fueling position eliminating the need apply a constant squeezing force to the gas lever during the entire fueling operation. The compressible gas lever lock includes a support assembly and a securing strap assembly. The support assembly includes top and bottom support plates connected together by a spring and a fabric outer cover. The securing strap assemblies holds the top and bottom support plates in the compressed configuration between uses for carrying in a purse or pocket.

1 Claim, 3 Drawing Sheets

COLLAPSIBLE GAS LEVER LOCK

TECHNICAL FIELD

The present invention relates to automobile accessories and more particularly to a collapsible gas lever lock that is inserted between the gas lever and the bottom of the gas pump handle to maintain the gas lever in the fueling position eliminating the need apply a constant squeezing force to the gas lever during the entire fueling operation; the compressible gas lever lock including a support assembly and a securing strap assembly; the support assembly including top and bottom support plates connected together by a spring and a fabric outer cover; each of the top and bottom support plates including a spring retainer structure extending outwardly therefrom between a base portion and an outermost portion; the outermost portion being of a greater diameter than the base portion; the spring having an inner coil diameter selected such that an end of the spring is snap fit over the outermost portion and resiliently returns to an inner diameter substantially equal to a bottom portion diameter such that the end of the spring is held in connection with the retaining structure; the securing strap assembly including a strap member and a strap faster element; the strap member having a first end permanently secured to one of the top and bottom support plates and a second end having a strap faster portion provided thereon that is companionate with the strap faster element; the strap faster element being secured to the same one of the top and bottom support plates as the first end of the strap member; the strap member being of a length such that, when the top and bottom support plates are fully compressed toward each other, the strap member is positionable around the support assembly and the strap faster portion securable to the strap fastener to hold the support assembly in the compressed configuration for carrying in a purse or pocket; one of the top and bottom support plates having a key ring attachment loop in connection therewith.

BACKGROUND ART

Many individuals find it difficult to maintain a constant grip of the gas lever of a gas refueling nozzle while refueling a vehicle. It would be a benefit to these individuals to have a gas lever lock that could be used to maintain the gas lever in the refueling position. Because the gas lever lock must be of a certain size to accomplish its task, most gas lever locks are difficult to carry in a purse or pocket. It would be a benefit, therefore, to have a gas lever lock that was collapsible for carrying in a purse or pocket and extendable for use.

GENERAL SUMMARY DISCUSSION OF INVENTION

It is thus an object of the invention to provide a collapsible gas lever lock that includes a support assembly and a securing strap assembly; the support assembly including top and bottom support plates connected together by a spring and a fabric outer cover; each of the top and bottom support plates including a spring retainer structure extending outwardly therefrom between a base portion and an outermost portion; the outermost portion being of a greater diameter than the base portion; the spring having an inner coil diameter selected such that an end of the spring is snap fit over the outermost portion and resiliently returns to an inner diameter substantially equal to a bottom portion diameter such that the end of the spring is held in connection with the retaining structure; the securing strap assembly including a strap member and a strap faster element; the strap member having a first end permanently secured to one of the top and bottom support plates and a second end having a strap faster portion provided thereon that is companionate with the strap faster element; the strap faster element being secured to the same one of the top and bottom support plates as the first end of the strap member; the strap member being of a length such that, when the top and bottom support plates are fully compressed toward each other, the strap member is positionable around the support assembly and the strap faster portion securable to the strap fastener to hold the support assembly in the compressed configuration for carrying in a purse or pocket; one of the top and bottom support plates having a key ring attachment loop in connection therewith.

Accordingly, a collapsible gas lever lock is provided. The collapsible gas lever lock includes a support assembly and a securing strap assembly; the support assembly including top and bottom support plates connected together by a spring and a fabric outer cover; each of the top and bottom support plates including a spring retainer structure extending outwardly therefrom between a base portion and an outermost portion; the outermost portion being of a greater diameter than the base portion; the spring having an inner coil diameter selected such that an end of the spring is snap fit over the outermost portion and resiliently returns to an inner diameter substantially equal to a bottom portion diameter such that the end of the spring is held in connection with the retaining structure; the securing strap assembly including a strap member and a strap faster element; the strap member having a first end permanently secured to one of the top and bottom support plates and a second end having a strap faster portion provided thereon that is companionate with the strap faster element; the strap faster element being secured to the same one of the top and bottom support plates as the first end of the strap member; the strap member being of a length such that, when the top and bottom support plates are fully compressed toward each other, the strap member is positionable around the support assembly and the strap faster portion securable to the strap fastener to hold the support assembly in the compressed configuration for carrying in a purse or pocket; one of the top and bottom support plates having a key ring attachment loop in connection therewith.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
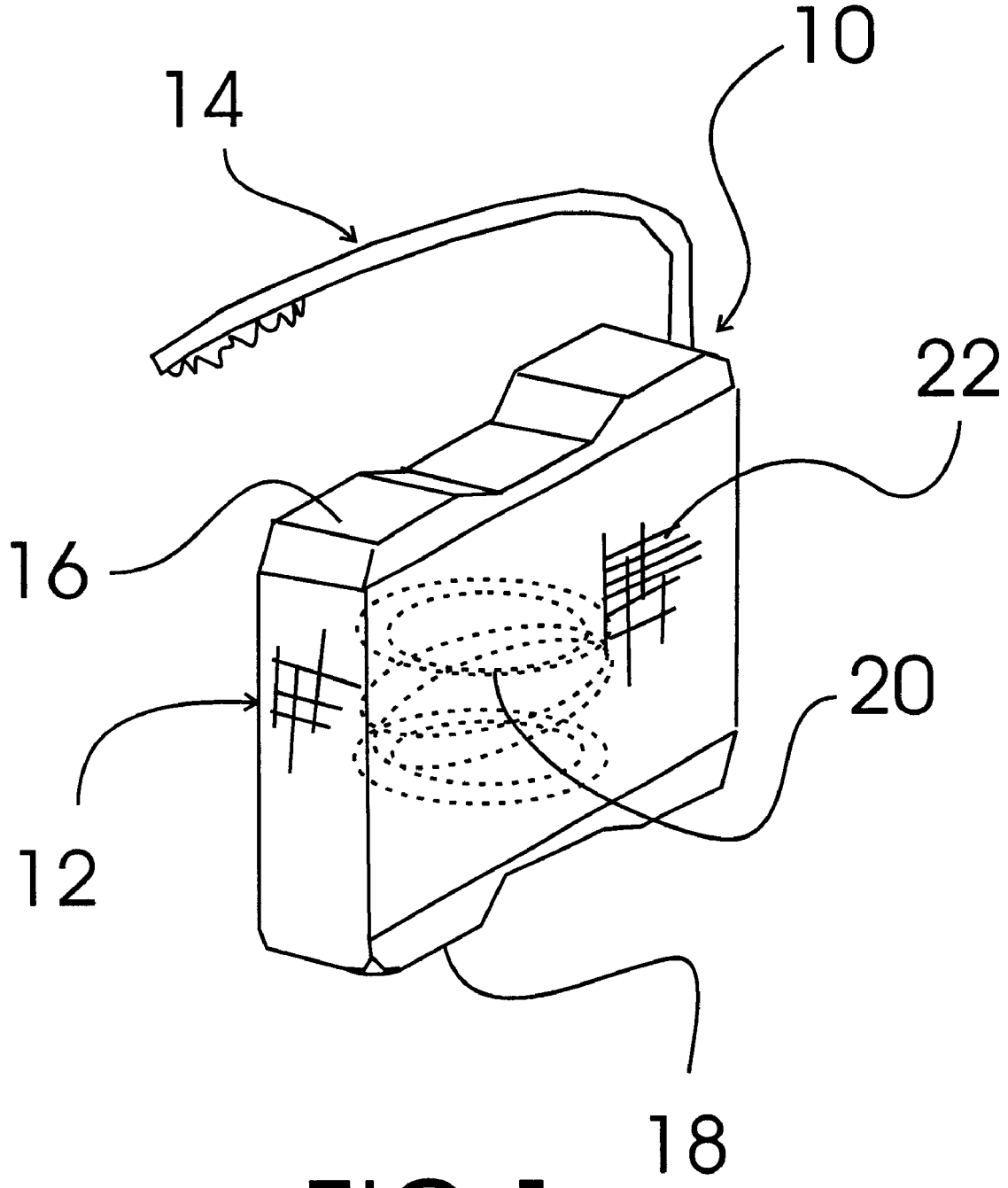
FIG. 1 is a perspective view of the compressible gas lever lock of the present invention showing the support assembly and the securing strap assembly; the support assembly including top and bottom support plates connected together by a spring and a fabric outer cover; each of the top and bottom support plates including a spring retainer structure extending outwardly therefrom between a base portion and an outermost portion; the outermost portion being of a greater diameter than the base portion; the spring having an inner coil diameter selected such that an end of the spring is snap fit over the outermost portion and resiliently returns to an inner diameter substantially equal to a bottom portion diameter such that the end of the spring is held in connection with the retaining structure; the securing strap assembly including a strap member and a strap faster element; the strap member having a first end permanently secured to one of the top and bottom support plates and a second end having a strap faster portion provided thereon that is companionate with the strap faster element; the strap faster element being secured to the same one of the top and bottom support plates as the first end of the strap member; the strap member being of a length such that, when the top and bottom support plates are fully compressed toward each other, the strap member is positionable around the support assembly and the strap faster portion securable to the strap fastener to hold the support assembly in the compressed configuration for carrying in a purse or pocket; one of the top and bottom support plates having a key ring attachment loop in connection therewith.
Figure 2:
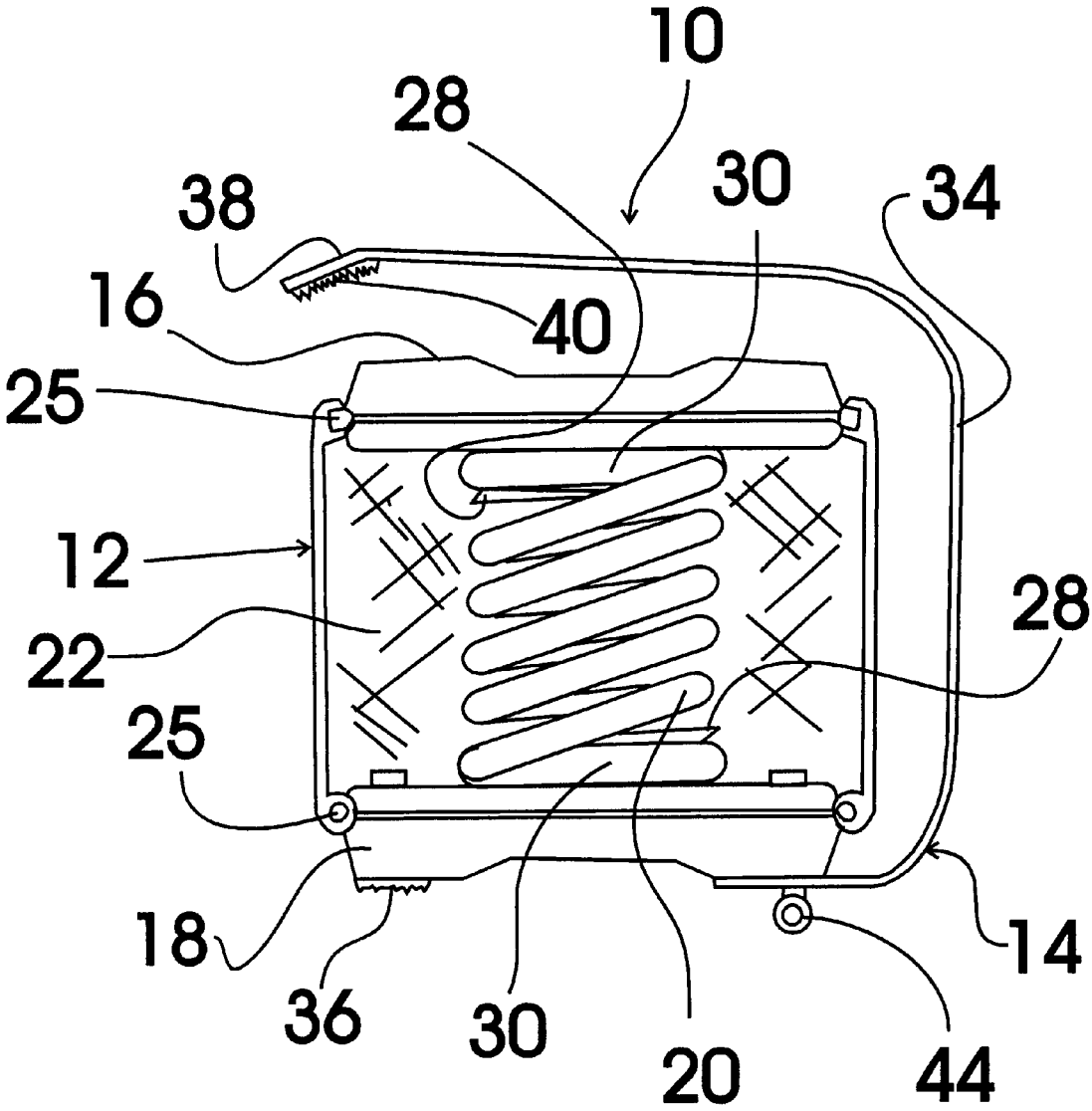
FIG. 2 is a side plan view of the compressible gas lever lock of FIG. 1 with a facing section of the fabric outer cover removed.
Figure 3:
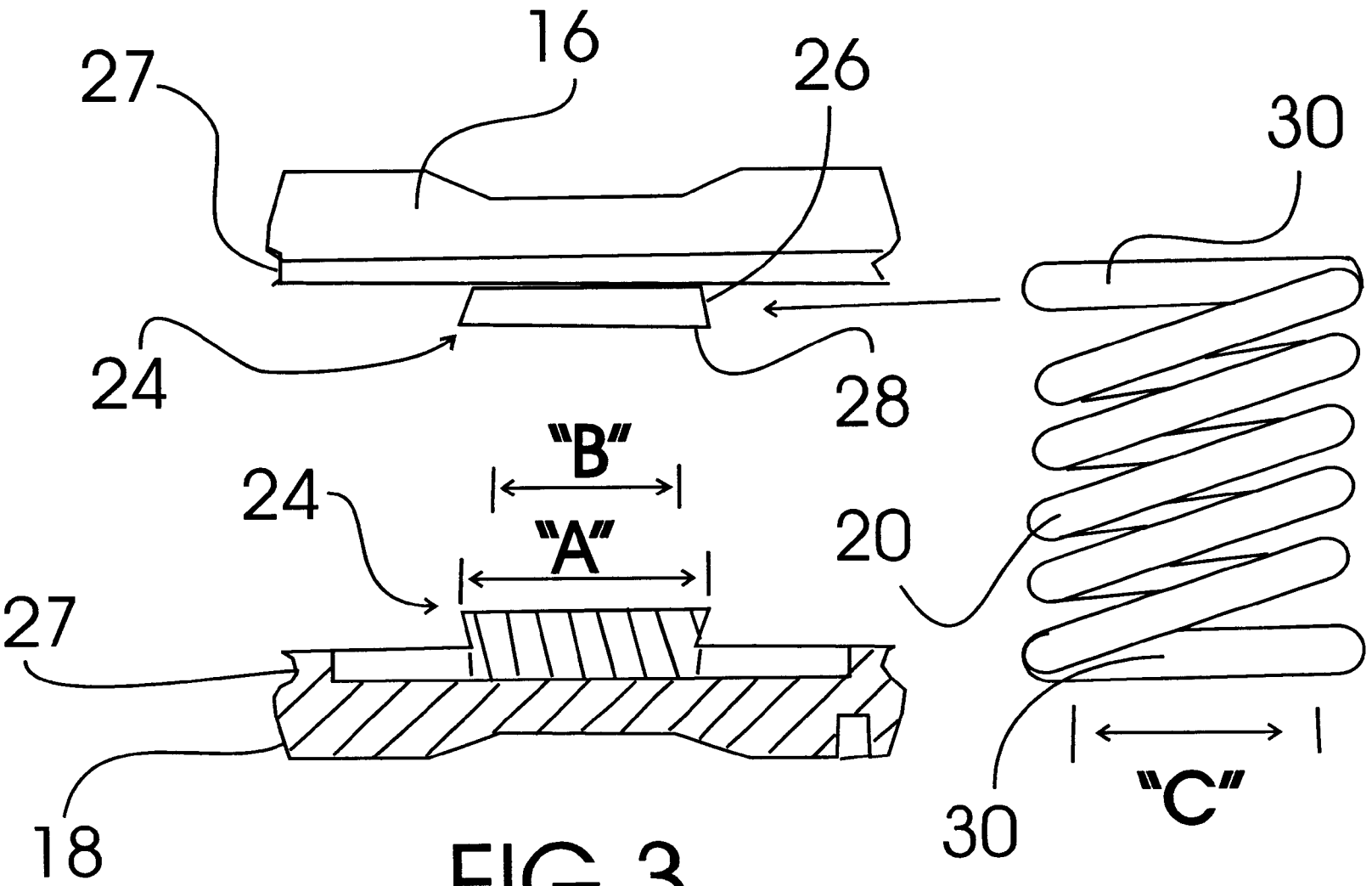
FIG. 3 is an exploded detail view of the top and bottom support plates and the spring showing the spring retainer structure extending from each of the top and bottom support plates including the base portion and the larger diameter outermost portion.

FIGS. 1–3 show various aspects of an exemplary embodiment of the collapsible gas lever lock of the present invention, generally designated 10. Collapsible gas lever lock 10 includes a support assembly, generally designated 12, and a securing strap assembly, generally designated 14.

Support assembly 12 includes top and bottom support plates 16,18 connected together by a spring 20 and a nylon fabric outer cover 22. Each of the top and bottom support plates 16,18 includes a spring retainer structure, generally designated 24 extending outwardly therefrom between a base portion 26 and an outermost portion 28. Outermost portion 28 has a diameter "A" which is greater than the diameter "B" of base portion 26. Spring 20 has an inner coil diameter "C" selected such that an end 30 of spring 20 is snap fit over outermost portion 28 and resiliently returns to an inner diameter "C" substantially equal to diameter "B" of bottom portion 26 such that the end 30 of spring 20 is held in connection with retaining structure 24. Outer cover 22 is a nylon fabric tube connected between top and bottom support plates 16,18 with retaining rings 25 that each snap fit into a retaining ring channel 27 formed around the perimeter edge of each of top and bottom support plates 16,18.

Securing strap assembly 14 includes a nylon strap member 34 and a strap faster element 36. Strap member 34 has a first end 40 permanently secured to one of the top and bottom support plates 16,18 and a second end 38 having a strap faster portion 40 provided thereon that is companionate with strap faster element 36. Strap faster element 36 is secured to the same one of the top and bottom support plates 16,18 as the first end 40 of strap member 34. Strap member 34 is of a length such that, when the top and bottom support plates 16,18 are fully compressed toward each other, strap member 34 is positionable around support assembly 12 and strap faster portion 40 is securable to strap fastener 36 to hold support assembly 12 in the compressed configuration for carrying in a purse or pocket. Bottom support plate 18 has a key ring attachment loop 44 in connection therewith.

It can be seen from the preceding description that a collapsible gas lever lock has been provided.

It is noted that the embodiment of the collapsible gas lever lock described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A collapsible gas lever lock that is inserted between the gas lever and the bottom of the gas pump handle to maintain the gas lever in the fueling position eliminating the need apply a constant squeezing force to the gas lever during the entire fueling operation, the collapsible gas lever lock comprising:

a support assembly; and a securing strap assembly;

said support assembly including top and bottom support plates connected together by a spring and a fabric outer cover;

each of said top and bottom support plates including a spring retainer structure extending outwardly therefrom between a base portion and an outermost portion;

said outermost portion being of a greater diameter than said base portion;

said spring having an inner coil diameter selected such that an end of said spring is snap fit over said outermost portion and resiliently returns to an inner diameter substantially equal to a bottom portion diameter such that said end of said spring is held in connection with said retaining structure;

said securing strap assembly including a strap member and a strap faster element;

said strap member having a first end permanently secured to one of said top and bottom support plates and a second end having a strap faster portion provided thereon that is companionate with said strap faster element;

said strap faster element being secured to said same one of said top and bottom support plates as said first end of said strap member;

said strap member being of a length such that, when said top and bottom support plates are fully compressed toward each other, said strap member is positionable around said support assembly and said strap faster portion securable to said strap fastener to hold said support assembly in said compressed configuration for carrying in a purse or pocket;

one of said top and bottom support plates having a key ring attachment loop in connection therewith.

* * * * *